US010441044B2

(12) United States Patent
Chiang et al.

(10) Patent No.: US 10,441,044 B2
(45) Date of Patent: Oct. 15, 2019

(54) CASE WITH SHOCK-ABSORBING IMPACT GEOMETRY

(71) Applicant: Samsonite IP Holdings S.àr.l., Luxembourg (LU)

(72) Inventors: Randy Yang Chiang, San Francisco, CA (US); Alan Yu Tung Ng, San Francisco, CA (US); Bryan Lee Hynecek, Redwood City, CA (US); Jon Karl Dukerschein, San Francisco, CA (US); Eric Frasch, San Francisco, CA (US); Syed Riaz Ahmed, San Leandro, CA (US); Ivan Chen, Mountain View, CA (US); Chris Novak, Gilroy, CA (US)

(73) Assignee: Samsonite IP Holdings S.àr.l., Luxembourg (LU)

( * ) Notice: Subject to any disclaimer, the term of this patent is extended or adjusted under 35 U.S.C. 154(b) by 0 days.

(21) Appl. No.: 15/596,707

(22) Filed: May 16, 2017

(65) Prior Publication Data

US 2018/0332939 A1 Nov. 22, 2018

(51) Int. Cl.
*A45C 13/00* (2006.01)
*A45C 11/00* (2006.01)
(Continued)

(52) U.S. Cl.
CPC ..... *A45C 13/002* (2013.01); *A45C 11/00* (2013.01); *A45C 13/36* (2013.01); *B65D 81/02* (2013.01);
(Continued)

(58) Field of Classification Search
CPC ..... A45C 5/00; A45C 11/00; A45C 11/02; A45C 13/00; A45C 13/002; A45C 13/02;
(Continued)

(56) References Cited

U.S. PATENT DOCUMENTS 7,093,717 B2 * 8/2006 Sakai ..... B65D 5/5021 206/564
D706,255 S 6/2014 Akana et al.
(Continued)

FOREIGN PATENT DOCUMENTS

WO WO 2012149304 A1 * 11/2012 ..... A45C 11/00

OTHER PUBLICATIONS

OtterBox Symmetry Case, posted at amazon.com, posting date not given, [online], [site visited Jul. 20, 2017]. Available from Internet, <URL: https://www.amazon.com/OtterBoxSYM-METRYCaseiPhoneONL Y/dp/801 K6PB3XG/>.
(Continued)

*Primary Examiner* — Bryon P Gehman
(74) *Attorney, Agent, or Firm* — Lerner, David, Littenberg, Krumholz & Mentlik, LLP

(57) ABSTRACT

A case for a mobile device, including first, second, third, and fourth sides, each with inside and outside surfaces opposite to each other. The inside surfaces of the first and second sides face each other. The inside surface of the third and fourth sides faces each other. The first and second sides are arranged between the third and fourth sides, and the third and fourth sides are arranged between the first and second sides, so that the four sides form at least part of a frame configured to surround a periphery of the mobile device. At least one of the inside surfaces of the first, second, third, and fourth sides includes triangular protrusions that have a triangular cross section and extend toward the inside of the case, so that an apex of each of the triangular protrusions contacts the mobile device when it is arranged inside the case.

17 Claims, 10 Drawing Sheets

(51) Int. Cl.
*B65D 81/02* (2006.01)
*A45C 13/36* (2006.01)

(52) U.S. Cl.
CPC ... *A45C 2011/001* (2013.01); *A45C 2011/002* (2013.01); *A45C 2011/003* (2013.01)

(58) Field of Classification Search
CPC ..... A45C 2011/001; A45C 2011/002; A45C 2011/003; A45C 13/36; B65D 81/02; B65D 81/022; G06F 1/16; H04B 1/3888; H04M 1/02; H04M 1/18; G09F 1/1626
USPC ..... 206/305, 320, 521, 523; 361/679.01, 361/679.26, 679.3, 679.55, 679.56
See application file for complete search history.

(56) References Cited

U.S. PATENT DOCUMENTS

| | | | | |
|---|---|---|---|---|
| 8,770,402 | B2 * | 7/2014 | Bergreen | H04B 1/3888 206/305 |
| D720,735 | S | 1/2015 | Turocy | |
| D721,360 | S | 1/2015 | Laffon de Mazieres et al. | |
| 9,060,580 | B2 * | 6/2015 | Tages | A45C 11/00 |
| D740,798 | S | 10/2015 | Poon et al. | |
| D747,707 | S | 1/2016 | Roberts et al. | |
| D747,708 | S | 1/2016 | Roberts et al. | |
| D753,641 | S | 4/2016 | Roberts et al. | |
| D754,651 | S | 4/2016 | Roberts et al. | |
| D754,652 | S | 4/2016 | Roberts et al. | |
| D756,344 | S | 5/2016 | Roberts et al. | |
| D757,702 | S | 5/2016 | Kanazawa | |
| D757,703 | S | 5/2016 | Kanazawa | |
| D757,704 | S | 5/2016 | Roberts et al. | |
| D772,854 | S | 11/2016 | Igarashi | |
| D775,615 | S | 1/2017 | Tien | |
| D776,100 | S | 1/2017 | Igarashi | |
| D776,645 | S | 1/2017 | Del Moral et al. | |
| D777,715 | S | 1/2017 | Sawaya | |
| D778,271 | S | 2/2017 | Stump et al. | |
| 9,615,476 | B2 * | 4/2017 | Rayner | G06F 1/1626 |
| D789,344 | S | 6/2017 | Kim | |
| 9,872,546 | B2 * | 1/2018 | Kim | A45C 11/00 |
| 10,027,783 | B2 * | 7/2018 | Dukerschein | A45C 11/00 |
| 2015/0119118 | A1 | 4/2015 | Ashley et al. | |
| 2015/0195929 | A1 | 7/2015 | Roberts et al. | |
| 2017/0187853 | A1 * | 6/2017 | Dukerschein | A45C 13/002 |
| 2017/0188676 | A1 | 7/2017 | Denike et al. | |

OTHER PUBLICATIONS

Incipio DualPro Case, posted at amazon.com, posting date not given, [online], [site visited Jul. 20, 2017]. Available from Intemet,<URL: https://www.amazon.com/iPhoneIncipioDualProShockAbsorbing/dp/B01JPIBZUO>.

LOHASIC 3-In-1 Case, posted at amazon.com, posting date not given, [online], [site visited Jul. 20, 2017]. Available from Intemet, <URL: https://www.amazon.com/RoybensAntiScratchAntifingerprintShockproofElectroplate/dp/B01 LMWO6DG>.

'Speck iPhone 7 Plus Presidio, posted at amazon.com, posting date Aug. 8, 2016, [online], [site visited Jul. 20, 2017]. 4vailable from Internet, <Url: https://www.amazon_com/SpeckProductsPresidioPhoneiPhone/dp/B01 JRU57Y2>.

* cited by examiner

CASE WITH SHOCK-ABSORBING IMPACT GEOMETRY

FIELD OF THE INVENTION

The present invention relates to a case for a mobile device. The case includes shock-absorbing impact geometry in the form of triangular ridges that protrude from the inner surface of the sides of the case.

Cases for mobile devices have been designed to provide at least some protection from impact events, such as when the device is dropped, hit, or otherwise struck. In order to provide such protection, materials are often employed which noticeably increase the thickness and weight of the case, and thus impact the portability and ease of use of the resultant protected device. One way to improve the impact protection of a case is to increase the amount of material in the case that provides the impact protection. But this increases the cost of the case in terms of materials, and further increases the size and weight of the case, which is undesirable to users.

US 2015/0195929 discloses a case for a mobile device, the case includes a band arranged to surround the edge of the device. The band includes a layer of flexible polymer. A separate layer of a damping material that is softer than the flexible polymer is provided within the flexible polymer layer. The damping material has a plurality of protrusions projecting inwardly from the inner periphery of the band to engage with the device. But these protrusions are thin semicircular protrusions. While these protrusion do absorb some shock, they are imperfect in that, as the protrusions deform/compress between the mobile device and the rest of the case, the surface area of the protrusions that contact the case to absorb the impact increases very quickly.

SUMMARY OF THE INVENTION

As such, it is desirable to provide a new case for a protective device which can provide increased shock/impact protection to a mobile device without adding significantly to the cost, size, or weight of the case.

According to the present invention there is therefore provided a case for a mobile device as described by way of example below and in the accompanying claims.

In one embodiment of the invention there is provided a case (1) for a mobile device, including: a first side (7) with an inside surface and an outside surface opposite to the inside surface; a second side (8) with an inside surface and an outside surface opposite to the inside surface; a third side (9) with an inside surface and an outside surface opposite to the inside surface; and a fourth side (10) with an inside surface and an outside surface opposite to the inside surface. The inside surface of the first side (7) faces toward the inside surface of the second side (8). The inside surface of the third side (9) faces toward the inside surface of the fourth side (10). The first and second sides (7,8) are arranged between the third and fourth sides (9,10), and the third and fourth sides (9,10) are arranged between the first and second sides (8,9), so that the first, second, third, and fourth sides (7,8,9,10) form at least part of a frame configured to surround a periphery of the mobile device when the mobile device is arranged inside the case. At least one of the inside surfaces of the first, second, third, and fourth sides (7,8,9,10) includes triangular protrusions (4) that have a triangular cross section and extend toward the inside of the case (1), so that an apex of each of the triangular protrusions contacts the mobile device when it is arranged inside the case.

In another embodiment, at least two of the inside surfaces of the first, second, third, and fourth sides (7,8,9,10) include the triangular protrusions (4).

In yet another embodiment, at least three of the inside surfaces of the first, second, third, and fourth sides (7,8,9,10) include the triangular protrusions (4).

In a further embodiment, the inside surface of the first side (7) is connected to the inside surface of the third side (9) to form a first corner, the first corner having an inside surface that includes at least one of the triangular protrusions (4).

In yet a further embodiment, the inside surface of the second side (8) is connected to the inside surface of the third side (9) to form a second corner, the second corner having an inside surface that includes at least one of the triangular protrusions (4).

In another embodiment, the inside surface of the second side (8) is connected to the inside surface of the fourth side (10) to form a third corner, the third corner having an inside surface that includes at least one of the triangular protrusions (4).

In yet another embodiment, the case (1) further includes a rear side (12) with an inside surface that faces toward, and an outside surface (6) that faces away from, the mobile device when it is arranged inside the case, the rear side (12) being connected to the first, second, third, and fourth sides (7,8,9,10) to form a pocket (19) configured to hold the mobile device.

In a further embodiment, outside surface (6) of the rear side (12) is formed by a first layer comprising a first material, and the inside surfaces of the first, second, third, and fourth sides (7,8,9,10) are formed by a second layer comprising a second material different from the first material.

In yet a further embodiment, the outside surfaces of the first, second, third, and fourth sides (7,8,9,10) are formed by the first layer comprising the first material.

In another embodiment, the inside surface of the rear side (12) is formed by the first layer comprising the first material, and the inside surface of the rear side (12) is configured to not touch the mobile device so that an air gap is created between the inside surface of the rear side (12) and the mobile device when it is arranged inside the case.

In yet another embodiment, the first material is translucent, transparent, or clear, so that the rear side (12) of the mobile device can be seen through the rear side of the case when the mobile device is arranged inside the case.

In a further embodiment, the inside surface of the rear side (12) is formed by the second layer comprising the second material.

In yet a further embodiment, both the first material and the second material are translucent, transparent, or clear, so that the rear side of the mobile device can be seen through the rear side (12) of the case when the mobile device is arranged inside the case.

In another embodiment, the first material includes at least one material selected from the group consisting of hardened plastic materials, rigid or semi-rigid plastic materials, rigid rubber materials, polycarbonate materials, metals, alloys, para-aramid materials, wood, glass, mirror, quartz, and combinations thereof.

In yet another embodiment, the second material includes at least one material selected from the group consisting of thermoplastic elastomers ("TPEs"), thermoplastic polyurethane ("TPU"), silicone, rubber, and combinations thereof.

It is noted that the features of the above-described embodiments are not exclusive to each other, and that any one of the above embodiments/features can be combined with one or more of the other embodiments/features to arrive at further embodiments.

The inventive case can be designed to fit a variety of mobile devices—such as smartphones and other portable electronic devices.

DETAILED DESCRIPTION OF EMBODIMENTS

Figure 1:
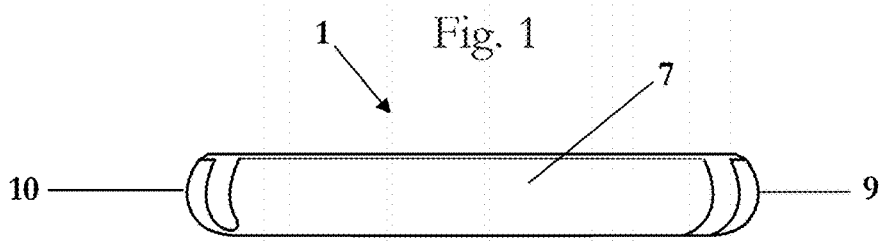
FIG. 1 is an upper side view of the case in accordance with an embodiment of the invention.
Figure 2:
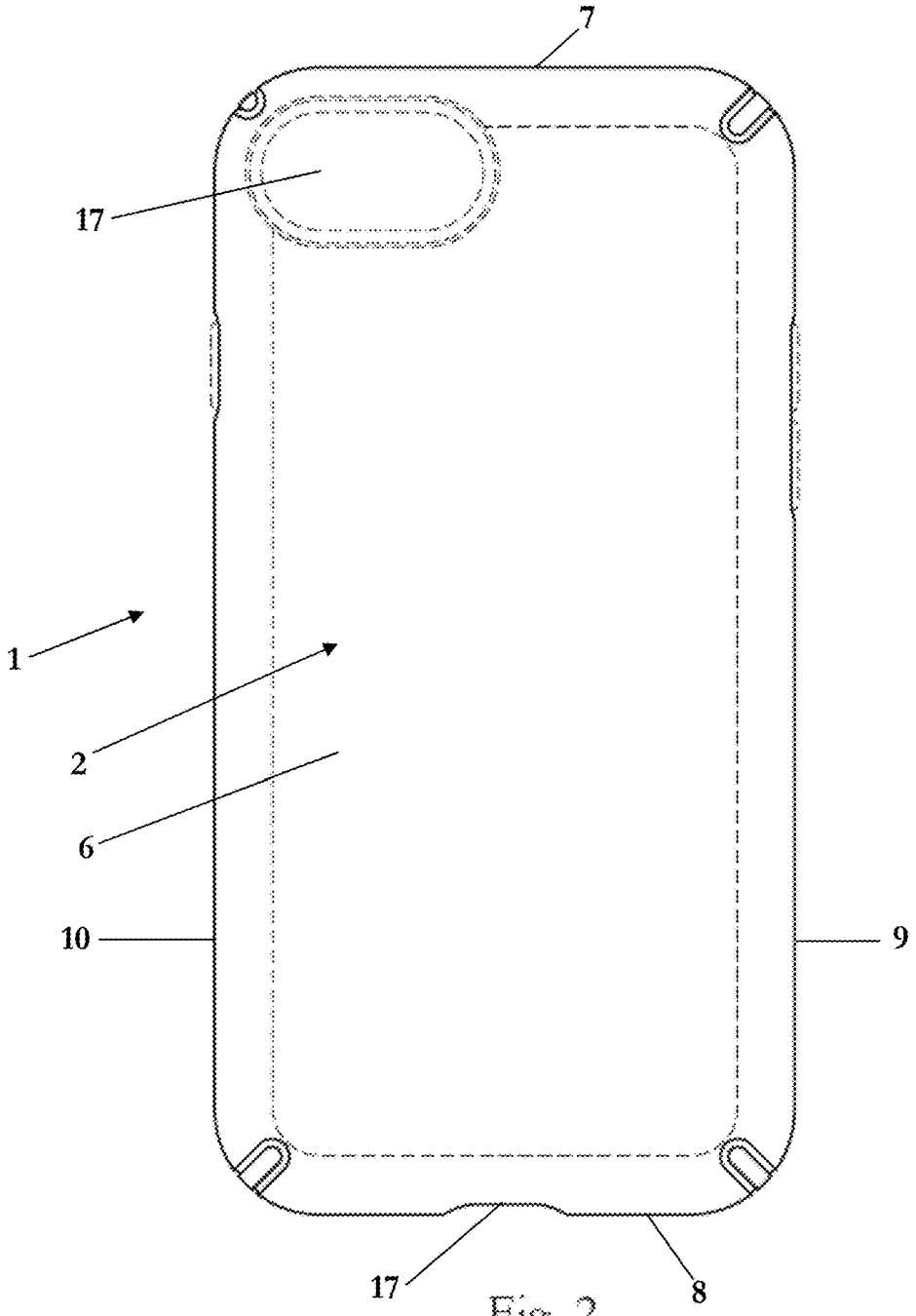
FIG. 2 is a rear view of the case in accordance with an embodiment of the invention.
Figure 3:
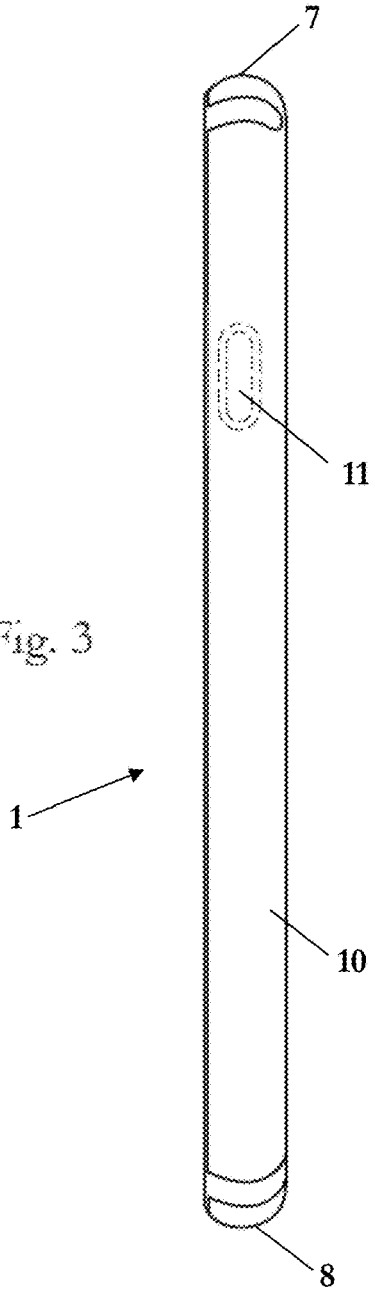
FIG. 3 is a right side view of the case in accordance with an embodiment of the invention.
Figure 4:
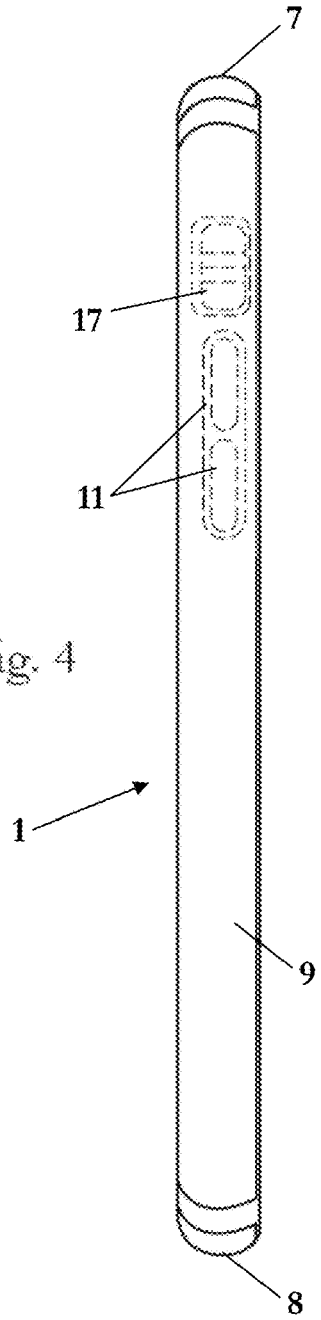
FIG. 4 is a left side view of the case in accordance with an embodiment of the invention.
Figure 5:
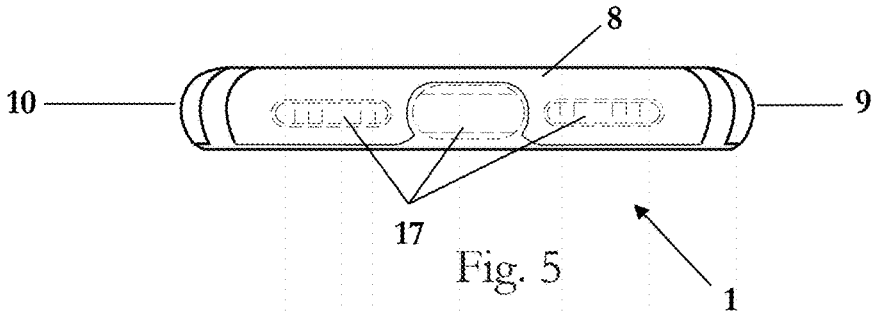
FIG. 5 is a lower side view of the case in accordance with an embodiment of the invention.
Figure 6:
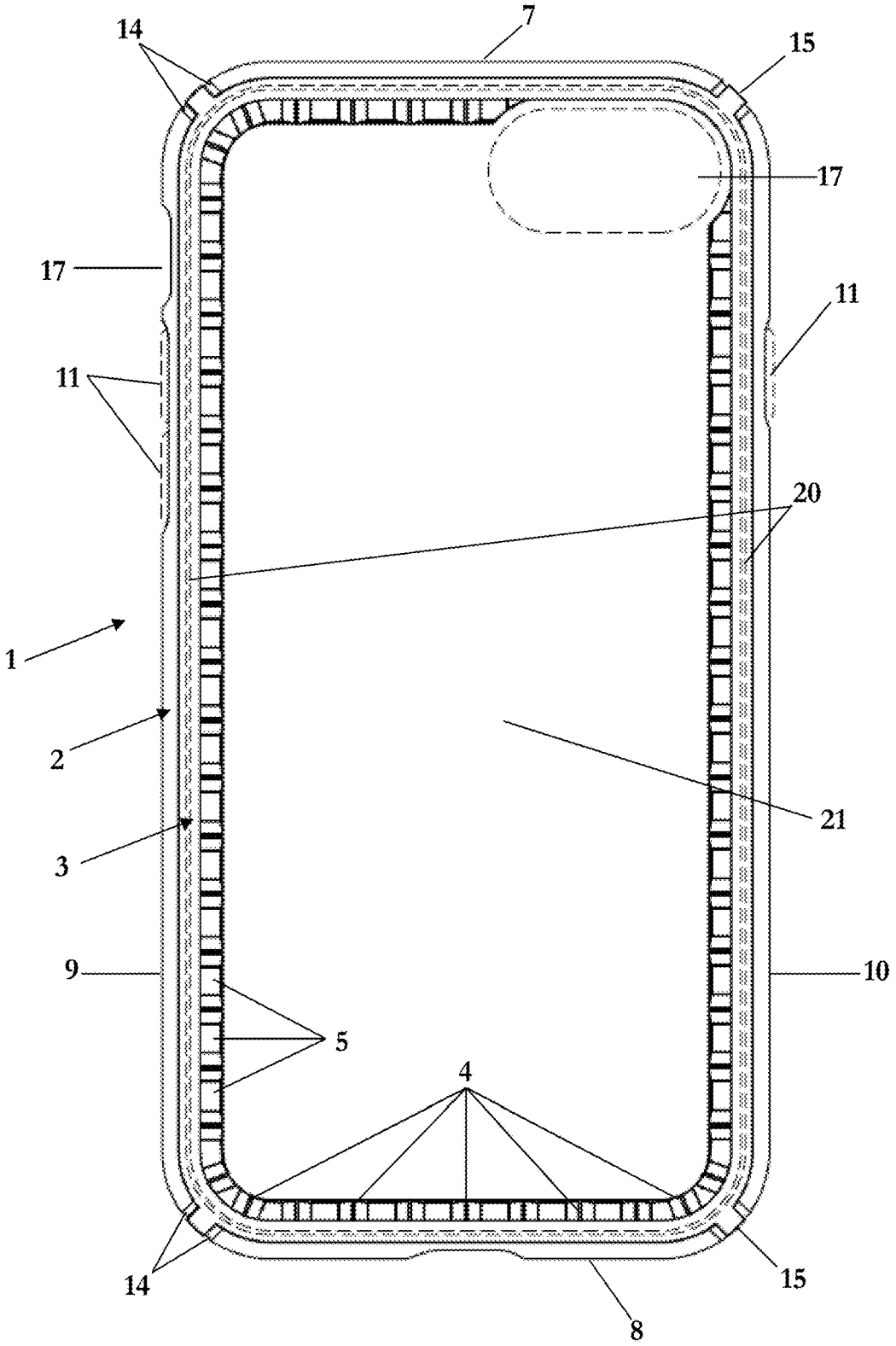
FIG. 6 is a front view of the case in accordance with an embodiment of the invention.
Figure 7:
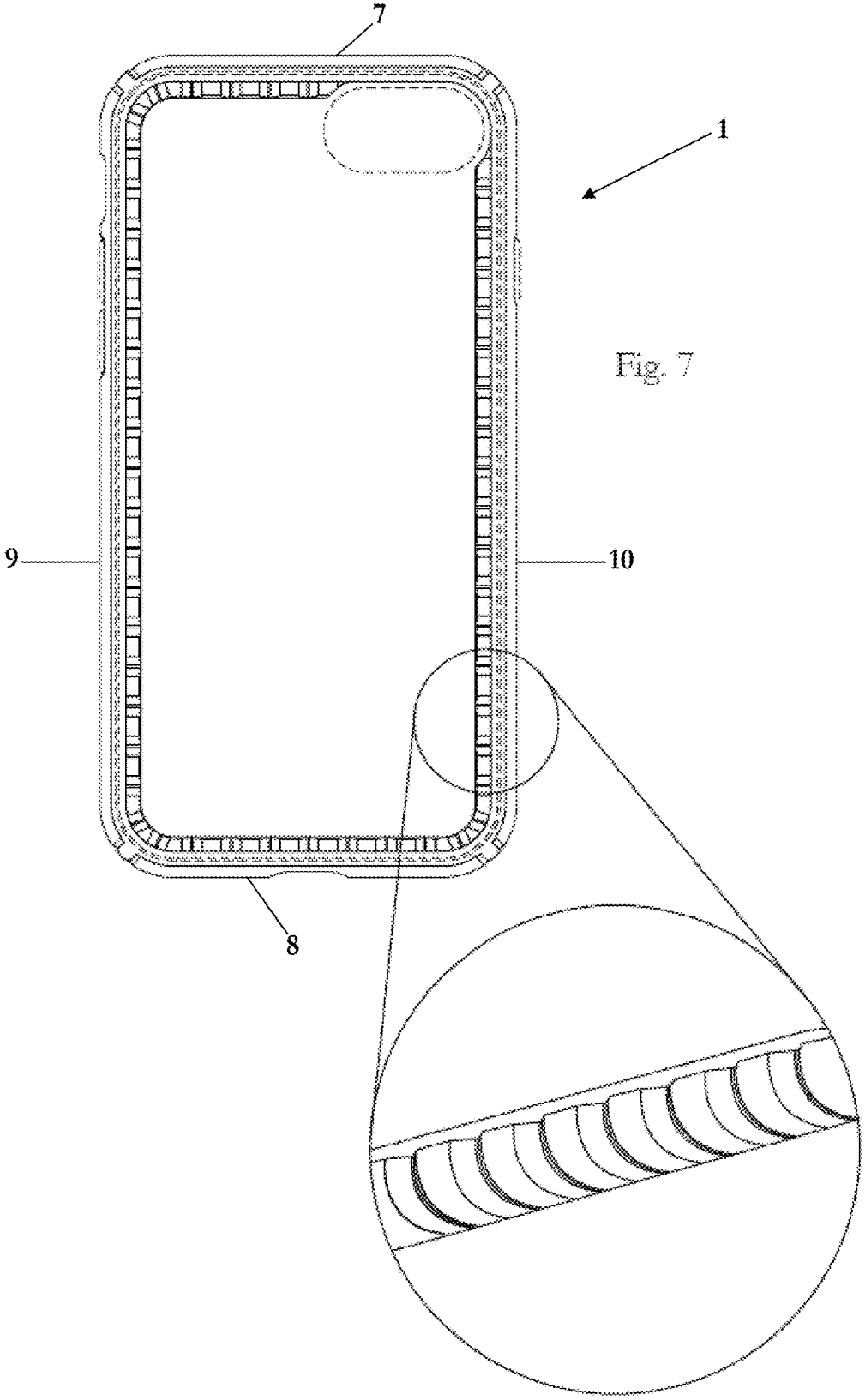
FIG. 7 is a front view of the case in accordance with an embodiment of the invention showing an enlarged view of a portion of the case.
Figure 8:
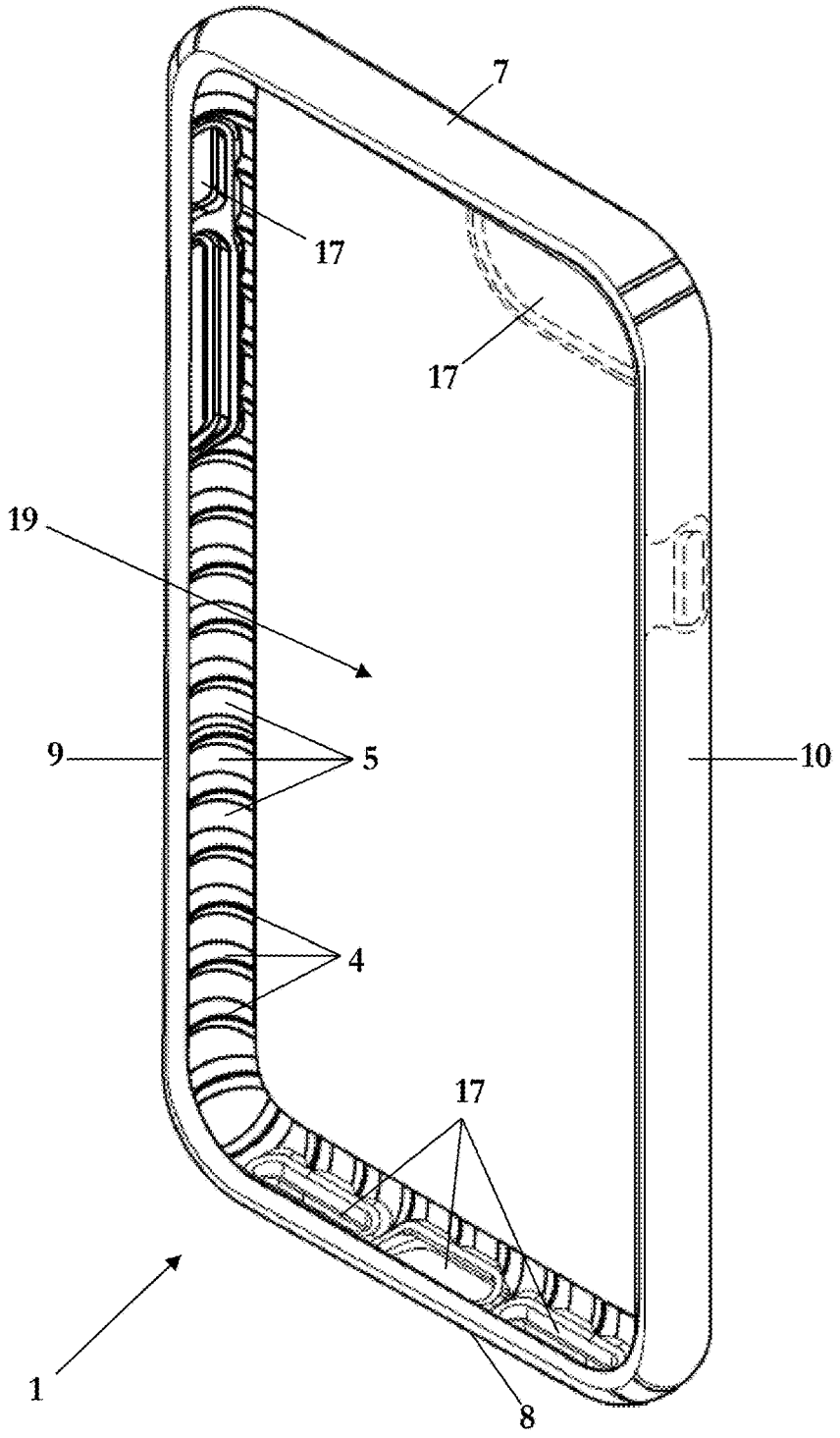
FIG. 8 is a front-right perspective view of the case in accordance with an embodiment of the invention.
Figure 9:
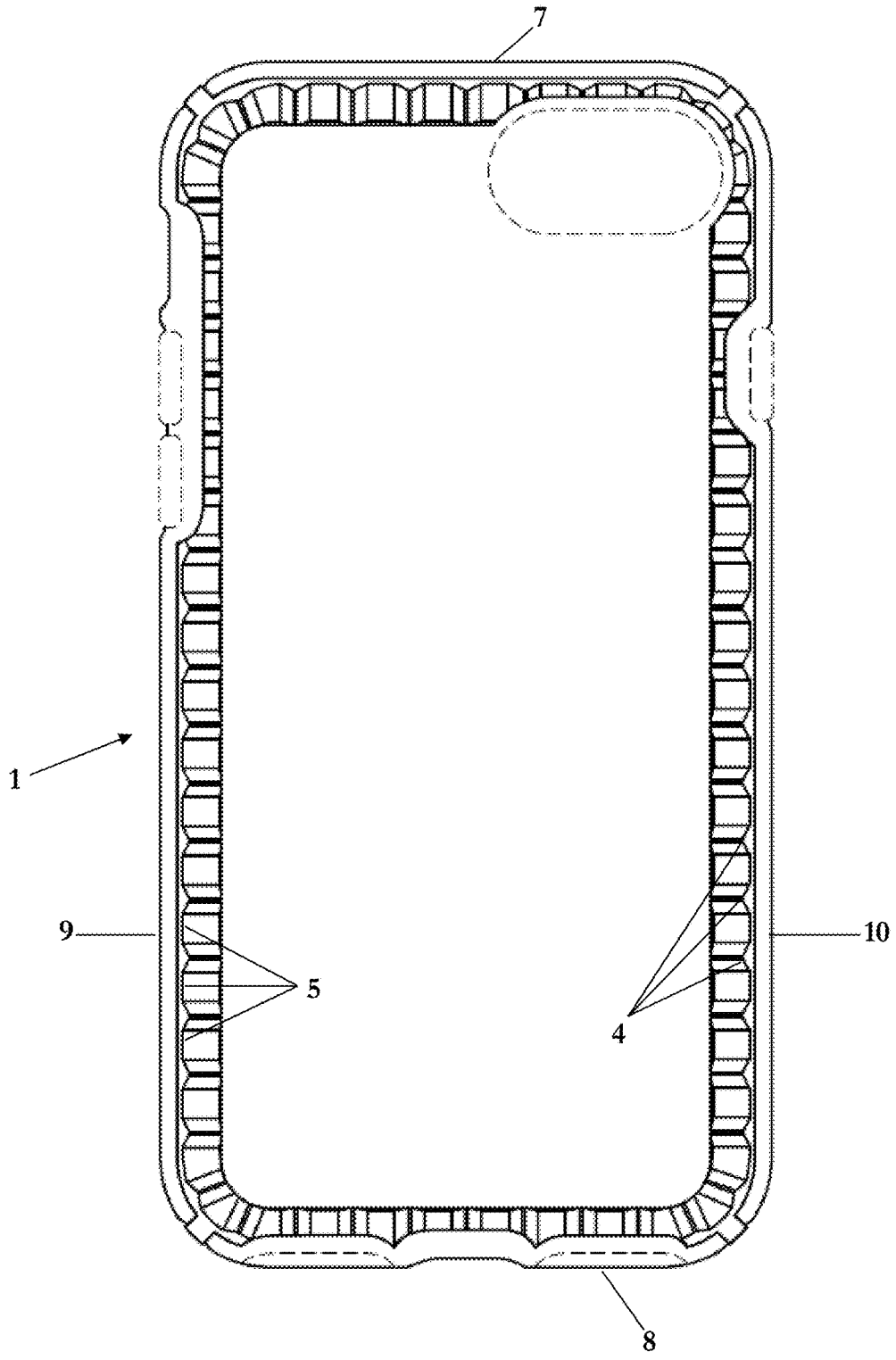
FIG. 9 is a front-view cutaway of the case in accordance with an embodiment of the invention.

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments. It is noted that any numerical ranges disclosed herein are included to individually disclose every sub-range and number, both whole integer and partial fraction, within the disclosed range. For example, a disclosed range of 1-100 is intended to individually disclose 20-90, 40-80, 30.5-50.2, 20, 67.3, 84.512924, and every other range and number that falls within the recited range.

A case according to an embodiment of the invention can be arrived at by providing shock-absorbing impact geometry to the interior of the case in the form of triangular ridges that protrude from the inner surface of the sides of the case. The narrow tops of the ridges contact the surface of the device. When force is applied between the outside of the case and the device, such as during an impact event, the force causes the triangular ridges to deform against the surface of the device. As force increase, further deformation of the ridges increases the volume of deformed material. This configuration allows the case to absorb impact and reduce the forces communicated to a device within the case in the event the device and case are dropped on a hard surface.

FIGS. 1-9 show an upper side view, a rear view, a right side, a left side view, a lower side view, a front view, a front view, a front-right perspective view, and a front-view cutaway, respectively, of the case in accordance with an embodiment of the invention. The case 1 includes a first layer or shell 2 and a second layer 3. The first layer or shell 2 includes a rear side having an inside surface (not shown) and an outside surface 6 opposite to the inside surface. An upper side 7, a lower side 8, a left side 9, and a right side 10 extend from the outside surface 6 of the rear side toward a front of the case 1 so as to form a pocket or recess in which the second layer 3 will be—and eventually a mobile device can be—arranged. The second layer 3 also includes a corresponding rear side having an inside surface 21, as well as one or more of corresponding upper, lower, left, and right sides. A pocket or recess 19 may be formed in second layer 3 for receiving the mobile device.

In one embodiment, the rear sides of the first layer 2 and second layer 3 overlay each other. The rear sides of the first layer or shell 2 and second layer 3 are also preferably substantially coextensive with each other so that the rear side of each layer covers at least 50% of the surface area of the rear side of the other layer. It is also preferable that the respective upper sides, lower sides, left sides, and right sides of the first layer 2 and second layer 3 are substantially coextensive with each other so that the respective upper sides, lower sides, left sides, and right sides of each layer covers at least 50% of the surface area of the corresponding side of the other layer. Additionally, it is preferable that the rear of the case (formed by the rear sides of the first layer 2 and second layer 3) is configured to cover at least 90%, if not all, of the rear of a mobile device when the mobile device is arranged within the case.

According to another embodiment, the respective upper sides, lower sides, left sides, and right sides of the first layer 2 and second layer 3 are only partially coextensive with each other so that the respective upper sides, lower sides, left sides, and right sides of the first layer 2 cover only a portion of the respective sides of the second layer 3.

The first layer or shell 2 is preferably formed from a rigid or hard material to create a rigid/hard outer shell which provides at least some impact protection as well as protection from being punctured by impacts with sharp objects. Examples of suitable hard/rigid materials include hardened plastic material, a rigid or semi-rigid plastic material, a rigid/hard rubber material, a polycarbonate material, a metal, an alloy, a para-aramid material, wood, glass, mirror, quartz, and any combination thereof, and may be any color or texture. Preferred materials include thermosetting plastics with a hard durometer having shore 30 D to shore 100 D, polycarbonate, poly(methyl methacrylate) ("PMMA"), metals, acrylonitrile butadiene styrene ("ABS"), PMMA, polyethylene terephthalate ("PET"), high durometer thermoplastic elastomers ("TPEs") and thermoplastic polyurethanes ("TPUs") having shore 30 D to shore 100 D, and any combination thereof. The hard protective exterior shell may be designed to mimic the finish of existing mobile devices, such as phones, MP3/4 players, tablets, laptops, and other mobile electronic devices. Many users like the feel of the original phone and would like to maintain that feel but still want protection for their device. The hard protective exterior shell of the present invention has a low coefficient of friction. This allows the device to be slipped in and out of pockets and bags easily with little resistance and without becoming attached to clothing or fabric materials—a major complaint from users when an elastomeric material is used for the outside of cases.

The outside surface of the first layer or shell 2 may be provided with a scratch resistant UV hardcoat, which resists scratches and prevents discoloration of the case due to UV exposure.

The second layer 3 is preferably formed from a soft elastomeric material which provides at least some shock protection from impact events such as drops or falls. Examples of suitable materials include thermoplastic elastomers ("TPEs"), thermoplastic polyurethane ("TPU"), polyolefins, silicone, rubber, and any combination thereof. The second layer 3 may also be designed so that there are no gaps between the rear of the mobile device and the inside surface 21 of the rear side of the case. This enables the case to have a very solid connection to the phone. The second layer 3 may additionally be formed with a lip or rim 20 so as to secure and retain the mobile device within the case 1. The elastomeric layer 3 also can be formed to have portions 11 designed to cover buttons on a mobile device. This allows a user to simply press the exposed portion 11 of the inner elastomeric layer 3 corresponding to the desired input of the mobile device.

The second layer 3 may also, or alternatively, be formed from a non-Newtonian dilatant material. The dilatant material is soft and flexible when at rest, but stiffens and/or hardens upon impact. In this way, the dilatant material is able to provide both impact protection by dispersing the force of an impact event along the surface of the second layer 3, and shock protection by absorbing some of the shock force of the impact event. This dual quality (i.e., absorbing and diffusing impact or impact forces) of the dilatant material allows for less material to be used to make the case—allowing for a thinner, lighter, and less bulky case which increases the portability of the protected mobile device—while still providing increased impact and shock protection to the mobile device encased therein.

Examples of suitable dilatant materials for the second layer 3 include materials made by D3O® (such as D3O® ST, D3O® XT, D3O® Shock+, and D3O® Aero), PORON® XRD™ made by Rogers Corporation, and ARTi-LAGE™ artificial cartilage foam made by ARTiLAGE™. Impact absorbing materials (such as foams) which have dilatant properties are especially preferred.

The dilatant material may have a hardness of at least 20 Shore OO, or may have a hardness of at least 5 Shore O. Preferably the hardness is at least 30 Shore OO, at least 50 Shore OO, at least 60 Shore OO, or at least 70 Shore OO. More preferably the hardness is in a range of 20-90 Shore OO, or in a range of 5-61 Shore O. More preferably still, the hardness is in a range of 30-80 Shore OO, or in a range of 5-40 Shore O. Even more preferably, the hardness is in a range of 40-70 Shore OO.

Preferably the second layer 3 has a hardness in the range of from 60-85 Shore A. If the second layer 3 is clear, its preferred hardness is 75-85 Shore A. If the second layer 3 is opaque, its preferred hardness is 60-75 Shore A.

Each of the first layer 2 and rear side of the second layer 3 is 0.5-4.0 mm thick. Preferably one or more of the layers is 0.6-3.0 mm thick. More preferably, one or more of the layers is 0.8-2.0 mm thick. Even more preferably, one or more of the layers is 0.9-1.3 mm thick.

Figure 10:
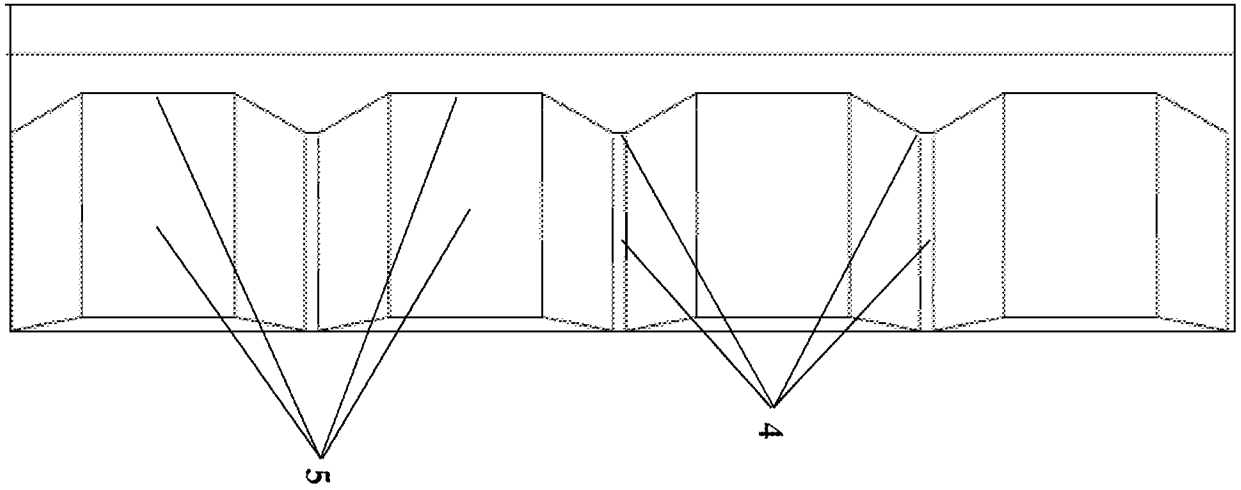
FIG. 10 shows a close-up view of the shock-absorbing triangular ridges 4 that protrude from the inner surface of the sides of the case, and the troughs 5 located between the triangular ridges 4.

The case 1 includes shock-absorbing impact geometry in the form of triangular ridges 4 that protrude from the inner surface of one or more sides of the case 1. Between each triangular ridge 4 is a trough 5. The triangular ridges 4 are formed by the second layer 3, and so are made of the elastomeric or non-Newtonian dilatant material of the second layer 3. FIG. 10 shows a close-up view of a section of the second layer 3 with the triangular ridges 4 and the troughs 5. This unique series of triangular ridges 4 act as a shock barrier and dissipate impact forces.

The triangular shape of the ridges 4 absorbs shock. The triangular ridges deform when force is applied between the surface of the device and the hard layer 3. The triangular shaped ridges deform in a different manner than semicircular or rectilinear protrusions, which may provide improved absorption of energy and less communication of forces to the device due to impact than protrusions of other shapes. In particular, as the triangular ridges 4 of the current invention compress and deform between the mobile device and the case upon impact, the surface area of the triangular ridges 4 gradually increase.

Figure 11:
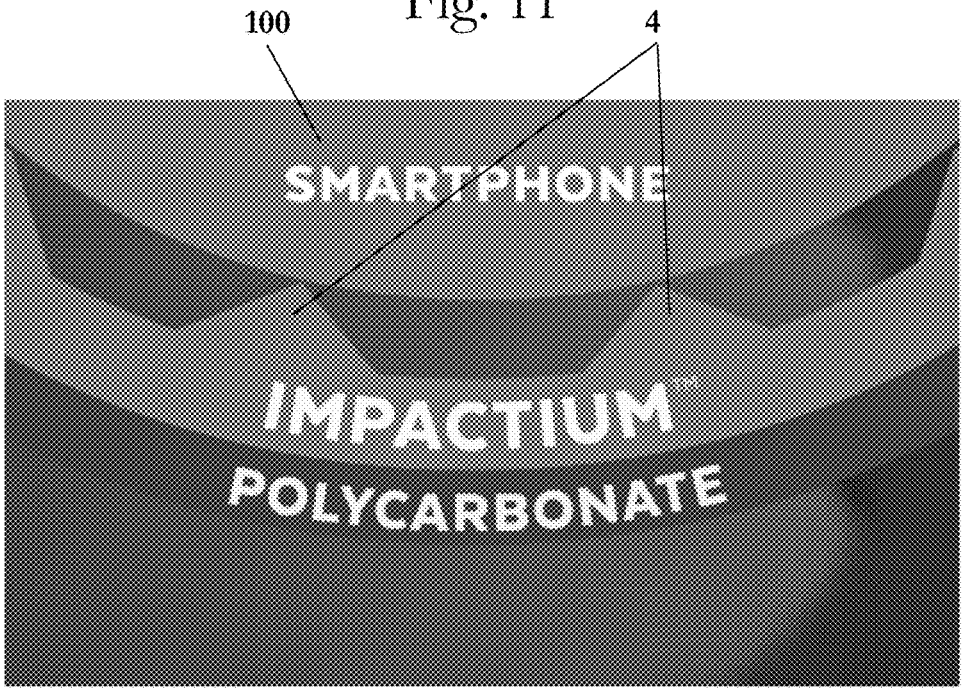
FIG. 11 shows a close-up cut-away view of the case 1 with a mobile device arranged therein prior to impact.
Figure 12:
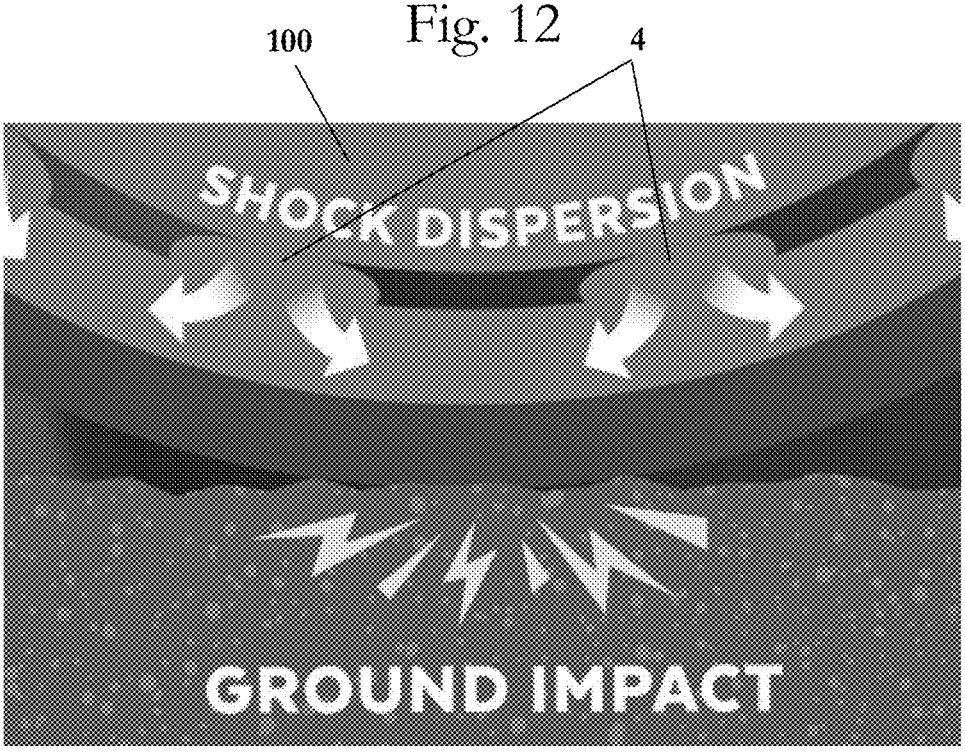
FIG. 12 shows a close-up cut-away view of the case 1 with a mobile device arranged therein during impact.

As shown in FIG. 11, the triangular ridges 4 only slightly contact the mobile device 100 arranged in the case 1. During impact, as shown in FIG. 12, the triangular ridges 4 compress against the mobile device 100, gradually changing shape (in cross section) from a triangular shape to a trapezoidal shape, and eventually to a rectilinear shape. This gradual change in cross-sectional shape of the triangular ridges 4 means that the shock-absorbing capability of the ridges 4 increases non-linearly—first due to the properties of the ridge material itself as it compresses and absorbs shock (i.e., the same way a solid and smooth layer of that material would absorb shock upon compression), and second due to the change in cross-sectional shape independent of the ridge material. The gradual change in cross-sectional shape of the triangular ridges 4 provides a slower decrease in velocity (i.e., a lower deceleration) of the mobile device during impact as compared to a semi-circular shape (which quickly becomes rectilinear) and a rectilinear shape (which is doesn't change its type of shape and merely compresses). Such a reduced deceleration results in less shock being absorbed by the mobile device, as it is instead absorbed by the gradual change in cross-sectional shape of the triangular ridges 4.

According to some embodiments the triangular ridges 4 protrude from the troughs 5 at a distance in the range of 0.300-4.00 mm, preferably 0.400-3.00 mm, more preferably 0.500-2.00 mm, and most preferably 0.600-1.50 mm. In one preferred embodiment, the distance between the surface of the troughs 5 and the tip of the triangular ridges 4 is around 1.00 mm.

The first layer 2 and second layer 3 may be co-molded/co-casted together or otherwise permanently affixed to each other, such as with an adhesive.

Alternatively, the first layer 2 and second layer 3 may be separable from one another as two distinct pieces. In such an instance, the two layers can be configured so that they mechanically engage with each other to form a unitary case. For example, the first layer 2 may be designed with slots or cutouts 14 into which corresponding ridges or ribs 15 of the second layer 3 engage (e.g., by snapping, pressure fitting, or any other suitable mechanical engagement). As another example opposite sides of the first layer 2 (e.g., upper side 7 and lower side 8, left side 9 and right side 10, or both) may be designed to snap onto and hold the second layer 3.

For example, one process for producing the case may be:

1. Mold the first layer 2; and
2. Place the first layer 2 into the overmold tool, and mold the second layer 3 onto the first layer 2.

Another example of a process for producing the case may be:

1. Mold the second layer 3; and
2. Place the second layer 3 into the overmold tool, and mold the first layer 2 onto the second layer 3.

Yet another example of a process for producing the case may be:

1. Mold the first layer 2;
2. Mold the second layer 3 (separately from, and before, after, or simultaneously with, the first layer 2); and
3. Join together the first layer 2 and the second layer 3.

It is noted that additional openings or cutouts 17 may be provided in at least a part of the case 1 so as to allow various buttons, ports, or features of a protected mobile device to be accessed without having to remove the mobile device from the case 1. For example openings or cutouts 17 may be provided to allow a user to engage a button of the protected mobile device either directly or via the cover portion 11 of the layer 3. As another example, cutouts 17 may be provided to create an opening in the case 1 though which a charging port, audio port, data port, or other electrical port of the mobile device may be accessed, either directly or via a pass-through connection. As yet another example, cutouts 17 may be provided to create an opening to expose a camera lens, audio speaker, microphone, or other feature of the device to be accessed or employed without removing the mobile device from the case 1.

In one embodiment, at least a portion of each of the first layer 2 and the second layer 3, corresponding to the rear of the case 1, is translucent, transparent, or clear, with a visible light transmittance (VLT) of at least 20%, so that the rear of a mobile device arranged in the case can be seen by a user through the first layer 2 and the second layer 3. Preferably, the portions of the first layer 2 and the second layer 3, corresponding to the rear of the mobile device, are translucent or clear. For example, at least a portion, if not all, of the first layer 2 may have a VLT of at least 20%, preferably at least 50%, more preferably at least 80%, more preferably still at least 90%, and most preferably 100%. Similarly, at least a portion, if not all, of the second layer 3 may have a VLT of at least 20%, preferably at least 50%, more preferably at least 80%, more preferably still at least 90%, and most preferably 100%.

Figure 13:
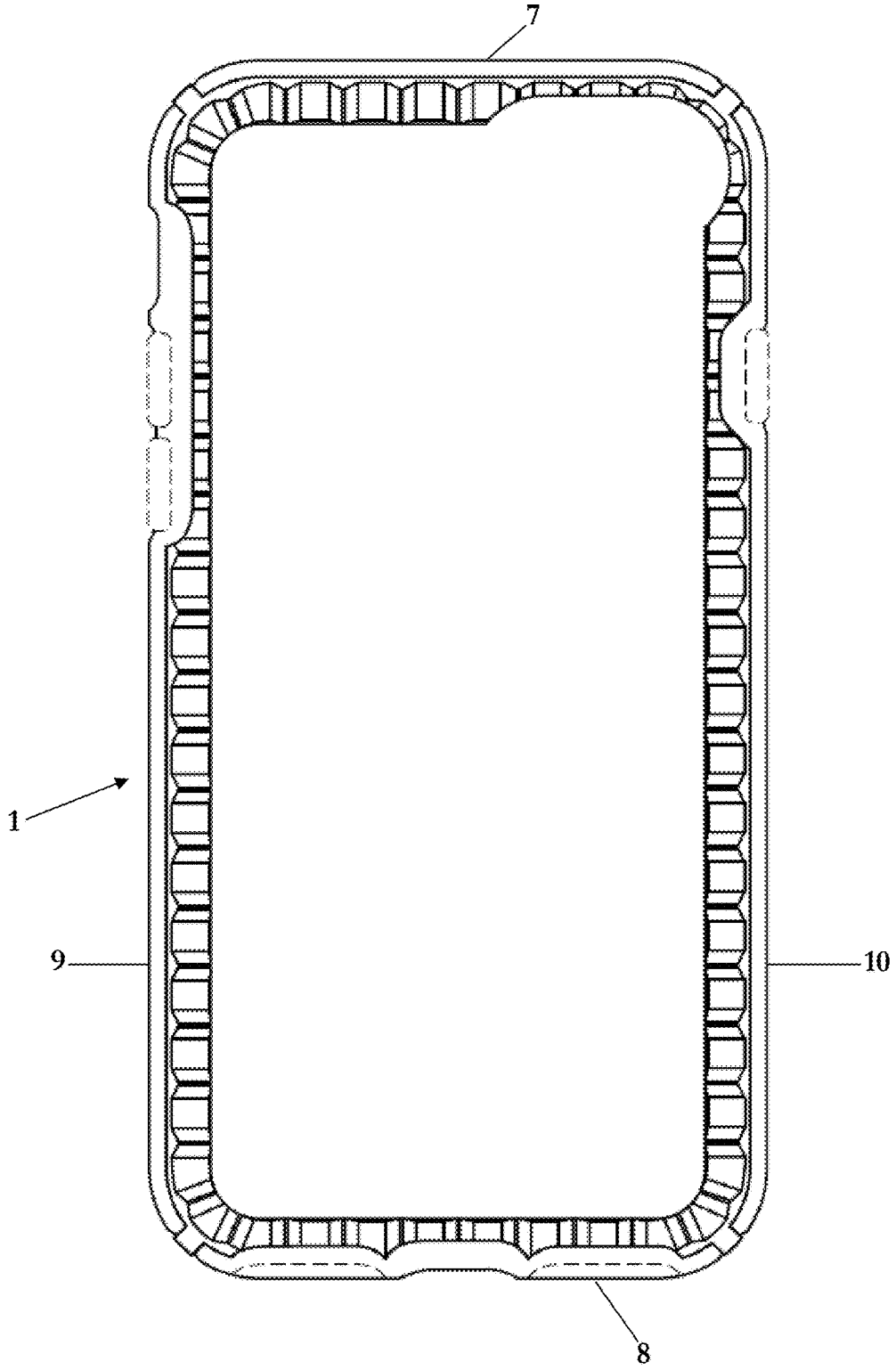
FIG. 13 is a front-view cutaway of the case in accordance with another embodiment of the invention.

FIG. 13 shows another embodiment of the invention. In this embodiment, the case 1 is configured as a bumper case. Any rear sides of the first layer or shell 2 and the second layer 3 cover no more than 25% of the rear side of a mobile device arranged within the bumper case. Preferably, any rear sides of the first layer or shell 2 and the second layer 3 cover no more than 15%, more preferably no more than 10%, and most preferably no more than 5%, of the rear side of a mobile device arranged within the bumper case. This allows an unobstructed view of the back of the case and decreases the weight (and potentially the thickness) of the case, while still providing impact protection to a perimeter of a mobile device arranged within the bumper case.

In this embodiment, the second layer 3 is configured as a bumper that sits against an inside periphery of the first layer 2. This embodiment is essentially the same as the embodiment shown in FIGS. 6-9, except the second layer 3 has little or no rear side having an inside surface 21.

The embodiment shown in FIG. 13 can also be configured so that the inner rear surface of the first layer 2 cover all, or a portion of the rear surface of the device as in the embodiments shown in FIGS. 1-9 but the second layer 3 is not disposed on the inner rear surface of the first layer 2. Instead, a gap is formed between the rear surface of the device and the inner rear surface of the first layer 2. According to this embodiment the inner surface of the rear side 12 of the first layer 2 does not contact the mobile device when arranged in the case 1. In this way, only the second layer 3 contacts the mobile device along the peripheral edge of the mobile device, and the first layer 2 does not touch the mobile device in any way when it is arranged in the case 1. This creates an air gap between the rear side 12 of the first layer 2 and the mobile device when arranged in the case 1, which provides some shock absorption for the rear of the mobile device in case of rear impact.

In a preferred version of this embodiment, at least the rear side 12 of the first layer 2, if not the entire first layer 2, is translucent, transparent, or clear, with a visible light transmittance (VLT) of at least 20%, so that the rear of a mobile device arranged in the case can be seen by a user through the first layer 2. For example, at least a portion of the rear side 12, if not all of the first layer 2, may have a VLT of at least 20%, preferably at least 50%, more preferably at least 80%, more preferably still at least 90%, and most preferably 100%. Such a clear rear side 12 makes visible the design of the device. Opaque material is used only for the perimeter of the case (e.g. the upper sides 7, lower sides 8, left sides 9, and right sides 10 of the first layer 2 and second layer 3). The second layer 3 covers all of the side surfaces and enough of the front and back surfaces so that impacts to any surface are absorbed by the material of the second layer 3. In this way the opaque second layer frames the back of the device, but does not obscure the back of the device—showing off the design of the device itself through the translucent, transparent, or clear first layer 2. The opaque material of the second layer 3 can also be used to create gaskets 13 around ports 17 such as the camera opening, preventing dust and debris from getting into the case.

The first layer 2 may also include relief slots or cutouts 14 in the hard material that allow the case to flex during installation and removal. Corresponding ridges or ribs 15 of the second layer 3 engage into the slots or cutouts 14. The second layer 3 includes the shock-absorbing impact geometry in the form of triangular ridges 4, as described above.

Figure 14:
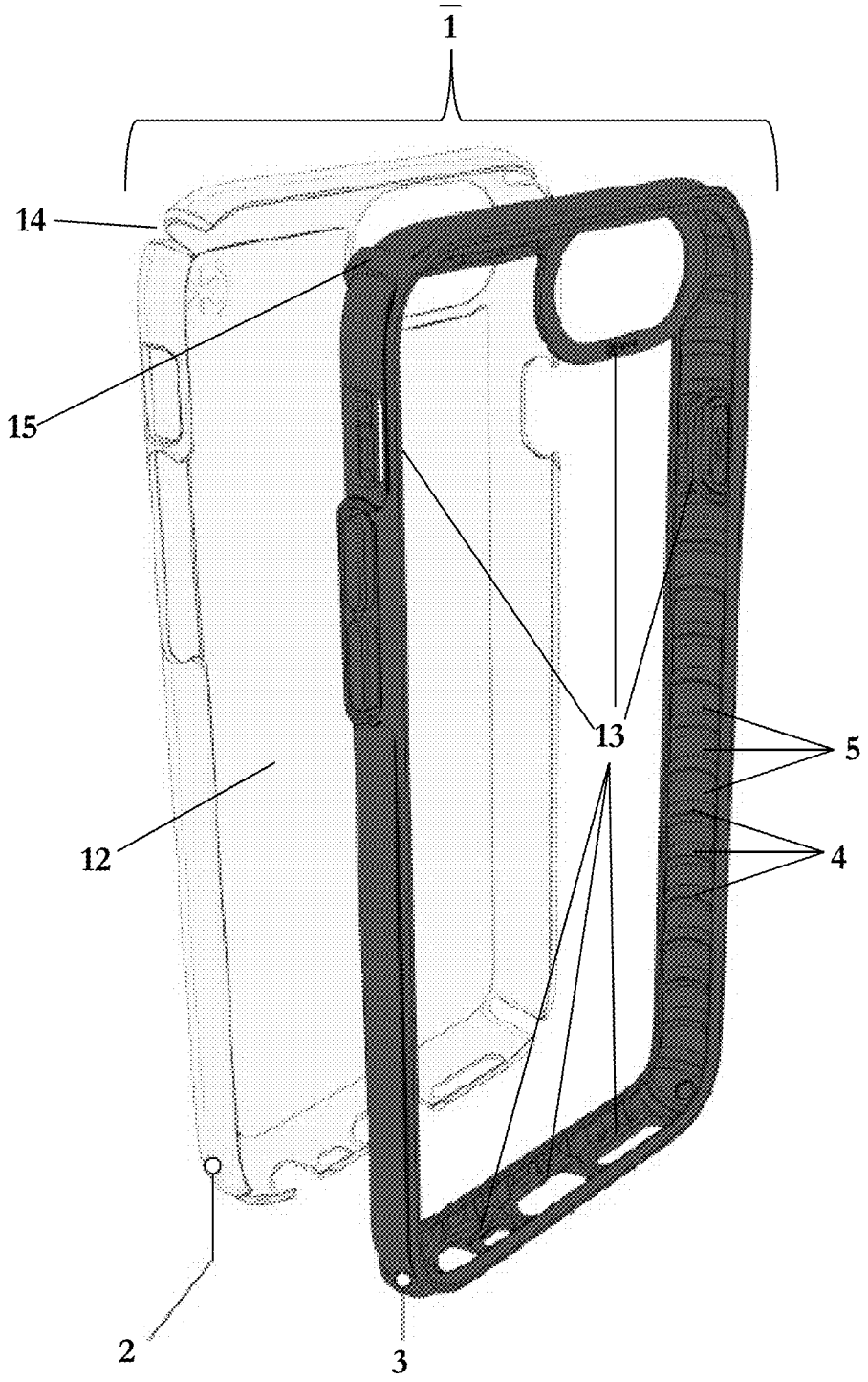
FIG. 14 is an exploded view of the case in accordance with another embodiment of the invention.

FIG. 14 shows an embodiment of a case with an opaque impact absorbing second layer 3 and a clear protective first layer 2. According to this embodiment, the inner rear surface of the first layer is separated from the rear surface of the device when the device is installed in the case. This arrangement is advantageous for devices with a high gloss surface finish because it prevents direct contact between the rear surface of the device and the inside rear surface of the case 1, which can create water spot effects.

The outside surface of the first layer or shell 2 is may be provided with a scratch resistant UV hardcoat, as described above, which resists scratches and prevents discoloration of the rear of the mobile device due to UV exposure.

While the embodiments of the case 1 shown in the drawing are made from the two layers 2, 3, it can also be made of a single layer 3 that forms both the interior and exterior of the case 1.

It is noted that the terminology used above is for the purpose of reference only, and is not intended to be limiting. For example, terms such as "upper", "lower", "above", "below", "rightward", "leftward", "clockwise", and "counterclockwise" refer to directions in the drawings to which reference is made. As another example, terms such as "inward" and "outward" may refer to directions toward and away from, respectively, the geometric center of the component described. As a further example, terms such as "front", "rear", "side", "left side", "right side", "top", "bottom", "horizontal", and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

In addition, it is noted that citation or identification of any document in this application is not an admission that such document is available as prior art to the present invention.

The invention claimed is:

1. A case for a mobile device, comprising:

a first side with an inside surface and an outside surface opposite to the inside surface;

a second side with an inside surface and an outside surface opposite to the inside surface;

a third side with an inside surface and an outside surface opposite to the inside surface; and a fourth side with an inside surface and an outside surface opposite to the inside surface;

wherein the inside surface of the first side faces toward the inside surface of the second side;

wherein the inside surface of the third side faces toward the inside surface of the fourth side;

wherein the first and second sides are arranged between the third and fourth sides, and the third and fourth sides are arranged between the first and second sides, so that the first, second, third, and fourth sides form at least part of a frame configured to surround a periphery of the mobile device when the mobile device is arranged inside the case;

wherein at least one of the inside surfaces of the first, second, third, and fourth sides includes triangular protrusions that have a triangular cross section and extend toward the inside of the case, so that an apex of each of the triangular protrusions contacts the mobile device when it is arranged inside the case.

2. The case for a mobile device according to claim 1;

wherein at least two of the inside surfaces of the first, second, third, and fourth sides include the triangular protrusions.

3. The case for a mobile device according to claim 1;

wherein at least three of the inside surfaces of the first, second, third, and fourth sides include the triangular protrusions.

4. The case for a mobile device according to claim 1;

wherein the inside surface of the first side is connected to the inside surface of the third side to form a first corner, the first corner having an inside surface that includes at least one of the triangular protrusions.

5. The case for a mobile device according to claim 4;

wherein the inside surface of the second side is connected to the inside surface of the third side to form a second corner, the second corner having an inside surface that includes at least one of the triangular protrusions.

6. The case for a mobile device according to claim 4;

wherein the inside surface of the second side is connected to the inside surface of the fourth side to form a third corner, the third corner having an inside surface that includes at least one of the triangular protrusions.

7. The case for a mobile device according to claim 1, further comprising:

a rear side with an inside surface that faces toward, and an outside surface that faces away from, the mobile device when it is arranged inside the case, the rear side being connected to the first, second, third, and fourth sides to form a pocket configured to hold the mobile device.

8. The case for a mobile device according to claim 7;

wherein outside surface of the rear side is formed by a first layer comprising a first material; and wherein the inside surfaces of the first, second, third, and fourth sides are formed by a second layer comprising a second material different from the first material.

9. The case for a mobile device according to claim 8;

wherein the outside surfaces of the first, second, third, and fourth sides are formed by the first layer comprising the first material.

10. The case for a mobile device according to claim 8;

wherein the inside surface of the rear side is formed by the first layer comprising the first material; and wherein the inside surface of the rear side is configured to not touch the mobile device so that an air gap is created between the inside surface of the rear side and the mobile device when it is arranged inside the case.

11. The case for a mobile device according to claim 10;

wherein the first material is translucent, transparent, or clear, so that the rear side of the mobile device can be seen through the rear side of the case when the mobile device is arranged inside the case.

12. The case for a mobile device according to claim 8;

wherein the inside surface of the rear side is formed by the second layer comprising the second material.

13. The case for a mobile device according to claim 12;

wherein both the first material and the second material are translucent, transparent, or clear, so that the rear side of the mobile device can be seen through the rear side of the case when the mobile device is arranged inside the case.

14. The case for a mobile device according to claim 8;

wherein the first material comprises at least one material selected from the group consisting of hardened plastic materials, rigid or semi-rigid plastic materials, rigid rubber materials, polycarbonate materials, metals, alloys, para-aramid materials, wood, glass, mirror, quartz, and combinations thereof; and wherein the second material comprises at least one material selected from the group consisting of thermoplastic elastomers ("TPEs"), thermoplastic polyurethane ("TPU"), silicone, rubber, and combinations thereof.

15. The case for a mobile device according to claim 1;

wherein the triangular protrusions are arranged along the at least one inside surface in an array extending from a first end of the at least one inside surface adjacent to one of the first, second, third, and fourth sides to a second end of the at least one inside surface opposite to the first end and adjacent to another of the first, second, third, and fourth sides.

16. The case for a mobile device according to claim 1;

wherein the triangular protrusions have a solid triangular cross section.

17. The case for a mobile device according to claim 1; wherein the apex of each of the triangular protrusions contacts a surface of the mobile device facing the at least one inside surface when the mobile device is arranged inside the case.

* * * * *